United States Patent [19]

Buchan et al.

[11] 4,395,113

[45] Jul. 26, 1983

[54] METHODS AND APPARATUS FOR CLEANING PHOTOCONDUCTIVE MEMBERS

[75] Inventors: William R. Buchan, Pepperell; Eddie W. Cielakie, Westford, both of Mass.

[73] Assignee: Nashua Corporation, Nashua, N.H.

[21] Appl. No.: 316,285

[22] Filed: Oct. 29, 1981

[51] Int. Cl.[3] ..... G03G 21/00

[52] U.S. Cl. ..... 355/15; 15/256.52; 134/1

[58] Field of Search ..... 355/15; 118/652; 15/256.52; 134/1

[56] References Cited

U.S. PATENT DOCUMENTS 3,807,853 4/1974 Hudson ..... 355/15
4,080,059 3/1978 Tani et al. ..... 355/15

FOREIGN PATENT DOCUMENTS 2034201 6/1980 United Kingdom ..... 355/15

*Primary Examiner*—R. L. Moses
*Attorney, Agent, or Firm*—Lahive & Cockfield

[57] ABSTRACT

Methods and apparatus for cleaning a photoconductive surface in order to remove toner particles dispersed in a liquid developer wherein a smooth-surfaced, resiliently deformable, yieldable roller means is compliantly engaged with the surface to be cleaned so as to form a generally concave, smooth surfaced cleaning pad spaced from the photoconductive surface by a gap not exceeding the diameter of minimum sized toner particles.

The yieldable roller means is rotated such that the surface of the concave, smooth faced portion thereof moves in an opposite direction relative to the direction of movement of the photoconductive surface and at a velocity at least equal to that of the photoconductive surface.

A uniquely interacting cleaning roller, sponge scrubber and doctor blade combination is also contemplated.

This method and apparatus are particularly effectively employd with liquid developer materials including a gel-like dispersant, with the cleaning roller means applying shearing forces to the developer so as to reduce the viscosity thereof and facilitate the overall cleaning action.

8 Claims, 3 Drawing Figures

METHODS AND APPARATUS FOR CLEANING PHOTOCONDUCTIVE MEMBERS

GENERAL BACKGROUND AND SUMMARY OF INVENTION

This invention relates to methods and apparatus for cleaning photoconductive surfaces and is specifically directed to such cleaning operations involving the removal of developer material where toner particles are suspended in a liquid dispersant.

Heretofore, practitioners in the liquid toner transfer art, when concerned with cleaning operations, have developed a variety of rotary sponge cleaning mechanisms. Such rotary sponge cleaning mechanisms have been utilized either by themselves or in combination with cleaning blades (i.e. doctor blades) which engage the photoconductive surface after the surface has been subjected to the scrubbing or particle loosening action of the rotary sponge means.

Such mechanisms, all to often, tend to induce scratching of the sensitive photoconductive surface. Moreover, removed toner particles tend to accumulate on the cellular surfaces of rotary cleaning sponges. Such accumulated toner particles tend to dry on such rotary cleaning sponges after a copying operation has been completed, and thus provide a coarse, dried particle surface which is likely to cause drum scratching when the machine is used for subsequent photocopying operations.

The present invention is specifically designed to avoid such drum scratching tendencies and entails, in one preferred format, the following cleaning method aspect:

providing elastically yieldable roller means having a smooth, yieldable periphery adjacent the periphery of a photoconductive surface;

moving the photoconductive surface so as to carry a layer of developer, comprising toner particles dispersed in a gelatex dispersant, generally toward the yieldable roller means;

applying a lubricating liquid to the developer layer;

pressing the yieldable roller means against the developer layer with its axes being parallel to the photoconductive surface and with the smooth yieldable periphery of the elastically, yieldable roller means being arcuately deformed into concave, smooth faced pad means penetrating the developer layer to a depth such that the concave smooth faced pad means is generally spaced from the photoconductive surface by a distance not exceeding the diameter of the minimum sized particles of the toner;

rotating the elastically yieldable roller means so that its periphery moves at a speed at least equal to the speed of the moving photoconductive surface but in a direction opposite thereto, with the rotation being operable to apply a shearing force to the gelatex dispersant operable to reduce the viscosity thereof;

maintaining a gap between the concave, smooth faced, pad means and the photoconductive surface, with the gap having a thickness not exceeding the diameter of the minimum sized toner particles;

scrubbing the photoconductive surface with rotary, yieldable sponge means before the developer layer is engaged by the concave pad means, with the rotating yieldable sponge means being operable to remove toner particles from the developer layer;

causing the rotating, yieldable sponge means to peripherally engage the rotating, elastically yieldable roller means and remove toner particles from the rotating, elastically yieldable roller means; and applying doctor blade means to the periphery of the rotating, elastically yieldable roller means so as to remove toner particles therefrom;

the lubricating fluid being applied to the developer layer between the rotating, yieldable sponge means and the rotating, elastically yieldable roller means and being operable to tend to flush at least some of the removed toner particles from the photoconductive surface; and the rotating, yieldable sponge means being compliantly engaged with the doctor blade means and operable to separate toner particles accumulated thereon.

Another independently significant aspect of the invention involves a method as above described not limited to cleaning operations involving gel-like materials or to the yieldable nature of the smooth cleaning roller.

A further independently significant aspect of the invention involves cleaning operations where the auxiliary, rotating yieldable sponge means is not necessarily employed.

Yet another independent method aspect of the invention involves the method aspect initially described, not limited to use with gel-like materials and not necessarily including the use of the auxiliary, rotating, yieldable sponge means.

As will be appreciated, each independently significant method aspect of the invention is related to a corresponding apparatus which includes means for implimenting the steps of each independently significant method facet of the invention.

In describing the invention, reference will be made by example, but not by way of limitation, to a presently preferred embodiment.

The presently preferred embodiment is illustrated in appended drawings which will now be described.

DRAWINGS OF PREFERRED EMBODIMENTS

In the drawings:

FIG. 1 provides a schematic, side elevational view of a typical photocopy machine adapted to the implementation of the present invention;

FIG. 2 provides a somewhat enlarged, fragmentary view of the FIG. 1 apparatus, illustrating one form of a composite cleaning apparatus which may be employed in the practice of the invention; and FIG. 3 provides an enlarged view of the FIG. 2 cleaning station, illustrating the manner in which a smooth faced, concave cleaning pad means is provided by the compliant interaction between a yieldable cleaning roller and a layer of developer material, with a slight gap being maintained between this smooth faced concave pad and the delicate photoconductive surface of the photocopier apparatus due to the hydraulic action of the liquid toner.

With the content of the application drawings having been delineated, it is now appropriate to give consideration to various preferred formats for practicing this invention.

DESCRIPTION OF PREFERRED EMBODIMENTS

In describing preferred embodiments in the invention, a brief discussion will be presented of a typical photocopier apparatus, following which the composition of a preferred developer material will be presented. Thereafter, structural and operational details of the cleaning concept of the present invention will be set forth.

Overall Copy Apparatus

The present invention may be advantageously practiced in the context of a photocopier apparatus of the general type featured in Davis et al U.S. Pat. No. 4,236,483 (Dec. 2, 1980), the disclosure of which is herein incorporated by reference.

Figure 1:
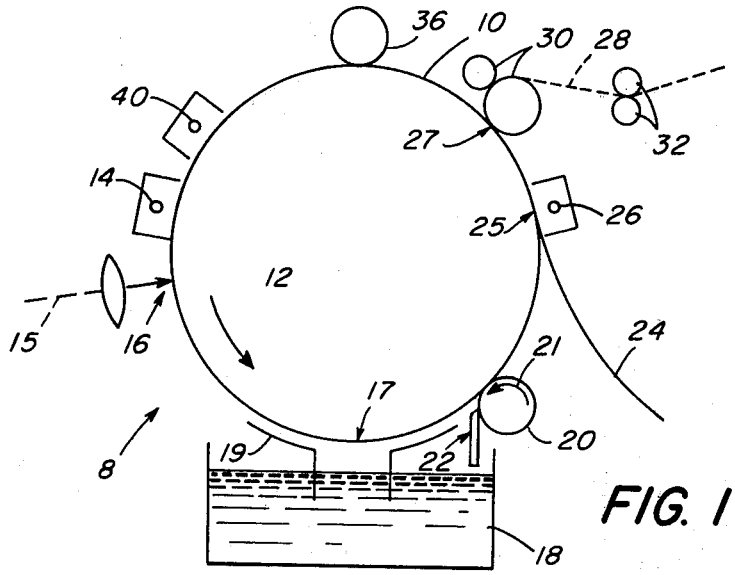

Such a photocopier 8, shown in FIG. 1, has a photosensitive drum 10. This drum 10 preferably has photosensitive selenium layer or surface deposited on an aluminum substrate, and may rotate in the counterclock direction as indicated by arrow 12. A charge corona 14 charges the drum 10 to about +1000 volts D.C. The charged drum is then exposed to an image 15 at an optical exposure station 16. The image is here focused on the drum photosensitive surface and thereupon the charge on the drum surface forms an electrostatic latent image comprising a pattern of electrical charges.

The electrostatic latent image on the drum surface is brought to a development station 17 where a liquid developer having, in the illustrated embodiment, a negatively charged toner, contacts the electrostatic image to develop the image. The development station includes a developer tank 18 and a development electrode 19. Developer is introduced between the development electrode and the drum surface to develop the electrostatic image.

The drum surface, now wetted and carrying the developed image, travels past a metering roll 20 which also may rotate in the counterclockwise direction as indicated by arrow 21. Metering roll 20 controls and limits the thickness of the liquid developer on the drum surface. A wiper blade 22 engages a peripheral portion of the metering roll 20, and removes the excess liquid that accumulates on the metering roll.

A copy material 24, which is usually paper sheet material, is fed to the drum surface at a transfer station 25. In this illustrated embodiment, a positive charge from a transfer corona 26 is applied to the back side of the copy material 24, causing the transfer of toner particles from the developed image on the drum's surface to the copy material. The copy material 24 is then removed from the drum surface at 27 and follows a path 28 dictated by roller means 30 and 32.

A particularly desirable paper "turn around" roller means 30, which functions to yieldably press paper sheets against drum 30 to improve the character of the transferred toner image, is featured in the U.S. patent application of Norman T. Veillette and William R. Buchan, entitled "Methods and Apparatus for Transferring Images", and filed concurrently with this application. The disclosure of this Veillette et al application is incorporated herein, by reference.

After transfer, there remains on the drum a residue of liquid developer. The drum is advantageously cleaned of this remaining residue by the cleaning mechanism of the present invention which may comprise a unique, drum surface contacting, compliant cleaning roller 36. Preferably a resiliently yieldable, smooth surfaced, cleaning roller, as hereinafter described, is employed by itself to perform this cleaning function, with this roller being deformably pressed against the drum surface and rotated in the same direction as drum 10.

Finally the drum surface is electrically neutralized prior to the next charging step by a high level A.C. neutralizing charge provided by a discharge corona 40.

Gel-like Toner Dispersant Characteristics

The instant invention is especially advantageous when employed with gel-like developer compositions which, in use, have improved depletion characteristics and produced copies of high image density. The use of such developers in conventional electrostatic copying machines allows upwards of 20,000 copies of high image density to be made before the developer must be replaced. These properties of the developer of the invention may be traced to the inclusion in the composition of a "gelatex". As used herein, the term "gelatex" refers to a mixture of vinyl polymers which together function both as a dispersant and a fixitive, that is, a mixture of a first polymer component on the borderline of solubility in the carrier or sparingly soluble in the carrier (gel component) and a second, carrier-insoluble component (latex). This "gelatex" consists essentially of a covalently cross-linked, vinyl polymer comprising a three dimensional multiply-branched molecular framework in the form of a gel, and a carrier insoluble vinyl polymeric latex physically entrapped and/or entangled within the three dimensional molecular framework.

The aforementioned developer comprises an organic carrier containing a pigment system, (i.e. toner particles), a charge control agent, and the "gelatex" which acts as a fixitive and a dispersant. The "gelatex" component is present in the carrier as a stable dispersion and is substantially uniformly depleted as multiple copies are produced, resulting in a significantly reduced rate of image density deterioration as multiple copies are produced.

The gel-like or "gelatex" toner dispersant, in connection with which this invention is deemed to be particularly efficacious, is described in detail in U.S. patent application Ser. No. 109,393, filed Jan. 3, 1980, identifying Norman T. Veillette and Charles H. C. Pian as co-inventors, entitled "Liquid Developer Compositions", and assigned to the assignee of the present invention.

The disclosure of the aforementioned Veillette application, Ser. No. 109,393, is herein incorporated by reference. By way of summary, it may be noted that the gelatex-based developer composition therein described may be characterized as follows:

A liquid developer composition for developing an electrostatic latent image on the surface of an image bearing member, which composition comprises:

an organic liquid carrier having a resistivity greater than $10^9$ ohm-cm and a dielectric constant less than 3;

a charge control agent;

a pigment; and a gelatex consisting essentially of a covalently cross-linked, vinyl polymeric gel on the borderline of solubility in said carrier and comprising a three-dimensional, multiply branched molecular framework and a carrier-insoluble vinyl polymeric latex physically held within said framework.

Cleaning Roller Structure and Operation

Figure 2:
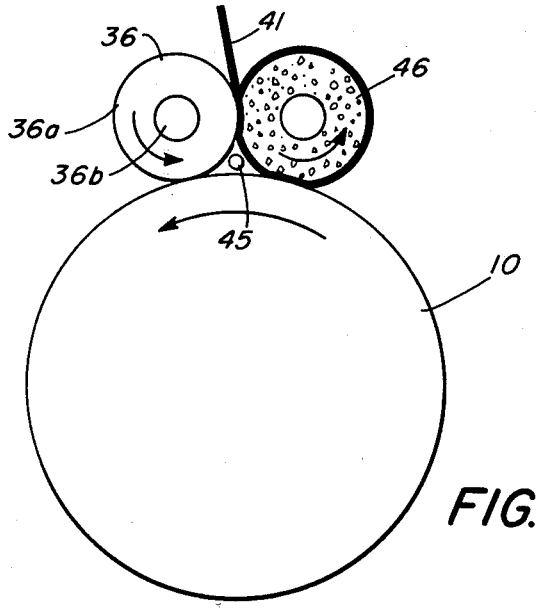
Figure 3:
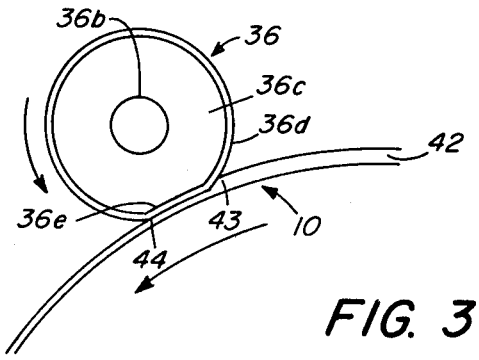

FIGS. 2 and 3 provide enlarged, schematic views illustrating structural and operational details of the cleaning mechanism 36, including auxiliary components which, in certain instances, may also be employed.

As shown in FIGS. 2 and 3, cleaning roller 36 may comprise a yieldably resilient roller fabricated, for example from polyurethane having a hardness measurement of from about 30 to about 50 durometers. Promising operation has been demonstrated using a polyurethane roller of about 50 durometers hardness rotating, as shown in FIG. 2, in a "reverse roller" sense in relation to the drum 10. In some tests conducted thus far, the roller 36 has been rotated in the same rotational direction as the drum 10, with the roller 36 rotating at a peripheral speed of about 64 feet per minute, where the peripheral speed of the photoconductive, selenium surface of the drum 10 was on the order of about 48 feet per minute, i.e. the peripheral speed of the roller 36 was about one and one half times that of the selenium surface and in an opposite direction.

In these tests, the polyurethane roller 36 was urged against the selenium drum with a pressure applying force on the order of about 15 pounds.

While roller 36 may comprise a polyurethane sleeve **36*a* mounted on a metallic or solid shaft 36*b*, it is also to be recognized, as shown in FIG. 3, that roller 36 may be fabricated with a cast polyurethane core 36*c* supported on shaft 36*b*, with an outer sprayed polyurathene coating 36*d* being applied to the exterior of intermediate layer 36*c*. In this arrangement, it is contemplated that the intermediate layer 36*c* may be somewhat softer than the smooth peripheral coating 36*d*. For example, the intermediate body 36*c*** may have a hardness on the order of 33 durometers, with the smooth outer layer or coating having a hardness on the order of about 70 durometers.

A doctor blade 41 may be disposed in a "forward facing" engagement mode with the cleaning roller 36, as generally shown in FIG. 2 and serve the purpose of removing toner material from the periphery of the cleaning roller. This removed toner material may then move free of the cleaning station or be otherwise removed from the system.

With the cleaning roller 36 and associated doctor blade 41 disposed and operated as noted above, the drum 10 rotates to carry a layer 42 of developer to be cleaned from the drum toward a nip zone 43 between the roller 36 and the drum 10.

As is noted in FIG. 3, the hydraulic influence of the developer layer 42, coupled with the compliant or yieldably resilient nature of the roller 36, will cause the roller 36 portion adjacent the drum 10 to be spaced slightly from the drum surface by a very small gap 44. The resilience of the roller 36, coupled with the pressure applied to the roller and the speed of the roller and drum are appropriately interrelated to be sure that the thickness of the gap 44 is not greater than the diameter of the minimum sized toner particles included in the developer layer 42.

As shown in FIG. 3, the flattened peripheral portion **36*e* of roller 36** defines a generally concave, smooth surfaced cleaning pad disposed in shearing engagement with the developer layer. This shearing engagement will induce a desired transient thinning or viscosity reduction of the gelatex dispersant to facilitate the overall cleaning operation.

The cleaning operation is further facilitated by injecting a lubricating liquid, usually the developer fluid, to the periphery of the drum 10, "upstream" of the roller 36 by way of nozzle means 45, as shown in FIG. 2. Nozzle means 45 may be supplied with developer from the reservoir 18 by appropriate pump means, not shown.

In certain instances, a relatively softer cleaning sponge roller, which may be fabricated, for example, from resilient polyurethane foam may also be employed. As shown in FIG. 2, such an auxiliary sponge 46 is disposed in compliant engagement with the periphery of the drum 10, the periphery of the roller 36, and the doctoring edge of the doctor blade 41. The synnergistically interacting influences wof the compliantly engaged components 36, 41 and 46 of the cleaning station provide an arrangement effecting cleaning not only of the drum 10 but also of each and all of the components 36, 41 and 46 of the composite cleaning arrangement.

At the present time, it is believed to be preferable to employ the roller 36 and doctor blade 41 in combination with the liquid applying means 45, without utilizing the auxiliary cleaning sponge 46 and its attendant drum scrubbing action. In not so utilizing the auxiliary sponge, a problem of potential loss of developer fluid to the atmosphere is avoided, i.e. the absorption of developer by the sponge is eliminated, thereby eliminating the loss to the atmosphere of developer absorbed by the sponge.

Where the sponge member 46 is employed, it is believed desirable for this sponge to be rotated with its axis of rotation being parallel to the axis of rotation of the drum 10 and the roller 36 and the direction of rotation of the sponge being the same as that of the roller 36 and the drum 10 so as to provide a "reverse roller" type of preliminary, relatively light, scrubbing action.

As will be appreciated, which ever format of cleaning station 36 is employed, it may desirable to provide appropriate retracting and applying means in relation to the components of the cleaning station. Such components are well recognized in the art and comprise mechanisms for moving the cleaning mechanism away from the periphery of the drum 10 at the completion of a cleaning operation so that the cleaning mechanism is disengaged from the drum at the start of the subsequent copy cylce.

Where the composite cleaning assembly shown in FIG. 2 is employed, the components 36, 41 and 46 may be retracted and applied as a unitized assembly. The same is true with respect to the presently preferred form of the cleaning station, i.e. the roller 36 and doctor blade 41 may be moved together as an integrated unit when retracted or away from or applied to the drum 10.

The complaint roller 36, with its axis parallel to that of the photoconductor drum, is rotated in contact with the developer layer. The sense and speed of the roller rotation are chosen so that, at the region of contact, the peripheral velocity of the roller is opposite to and at least equal in magnitude to the peripheral velocity of the drum.

Under these conditions, particles borne on the drum and approaching the region of contact are unable to enter the core 44. Thus, if a particle is strongly adherent to the drum it will be subjected to a very high shear force by the rotating roller, and so will be progressively sheared apart as it approaches the nip. If a particle is not strongly adherent to the drum, then, as it approaches the nip, it will be forced to roll by the opposite peripheral velocities.

Particles which are hard and adherent, such as a blob of glue stuck on the photoconductor, are not usually encountered in liquid toner transfer copier systems.

Furthermore, these do not cause drum scratching though they may cause other problems. The rotary squeegee is, therefore, effective in removing from a photoconductor drum the types of material that matter for a liquid toner photocopying process. It also dries the drum effectively.

Some of the particles removed from the drum, as discussed above, will adhere to the compliant roller 36. The remaining mechanisms shown in FIG. 2 are designed to put this material into suspension in liquid, so that it is removed from the system by liquid flow.

The feed nozzle 45 supplies liquid to the space between the solid complaint roller 36 and the foam roller 46. This lubricates the contacting surfaces and provides a vehicle for suspending particles. The scraper blade 41 bearing against the complaint roll 36, can be used alone to remove most of the material adhering to this the roll. Alternatively, the foam roller 46 can cooperate with the scraper blade 41 as shown in FIG. 2. The foam roller 46 interferes with both the compliant roll 36 and the drum 10, in order to loosen and remove material on both. It also washes the edge of the scraper 41 blade and minimizes the occurrence of recirculating particles adhering to the compliant roller 36. This is significant because the only scratching possible with the rotary squeegee 36 is that due to recirculation of particles adherent to it.

Having described structural and operational details of various preferred embodiments of the apparatus, it is now appropriate to summarize, in the context of claim language, the overall assembly shown in FIG. 2.

The FIG. 2 cleaning station includes elastically yieldable roller means 36 having a smooth, yieldable periphery located adjacent the periphery of the photoconductive surface of drum 10. This photoconductive surface is moved so as to carry a layer 42 of developer, comprising toner particles which may be dispersed in a gelatex dispersant, generally toward the yieldable roller means 36.

A lubricating liquid is applied to the developer layer by nozzle means 45.

The yieldable roller means 36 is pressed against the developer layer 42 with its axes being parallel to the photoconductive surface and with the smooth yieldable periphery of the elastically, yieldable roller means 36 being arcuately deformed into concave, smooth faced pad means **36*e*. This pad means penetrates the developer layer to a depth such that the concave smooth faced pad means 36*e*** is generally spaced from the photoconductive surface by a distance not exceeding the diameter of the minimum sized particles of the toner.

The elastically yieldable roller means 36 is rotated so that its periphery moves at a speed at least equal to the speed of the moving photoconductive surface but in a direction opposite thereto.

This rotation is operable to apply a shearing force to the gelatex dispersant operable to reduce the viscosity thereof.

A gap 44 is maintained between the concave, smooth faced, pad means **36*a* and the photoconductive surface, with the gap 44** having a thickness not exceeding the diameter of the minimum sized toner particles.

The photoconductive surface may be scrubbed with rotary, yieldable sponge means 46, softer than roller 36, before the developer layer is engaged by the concave pad means **36*e*, with this rotating yieldable sponge means 46** being operable to remove toner particles from the developer layer.

The rotating, yieldable sponge means 46 is caused to peripherally and compliantly engage the rotating, elastically yieldable roller means 36 and remove toner particles from this rotating, elastically yieldable roller means.

The doctor blade means 41 is applied to to the periphery of the rotating, elastically yieldable roller means 36 to remove toner particles therefrom.

A lubricating fluid is applied to the developer layer 42 between the rotating, yieldable sponge means 46 and the rotating, elastically yieldable roller means 36 and is operable to tend to flush at least some of the remove toner particles from the photoconductive surface.

The rotating, yieldable sponge means 46, when employed, is compliantly engaged with the doctor blade means and is operable to separate toner particles accumulated thereon.

ADVANTAGES, UNOBVIOUSNESS AND SCOPE OF THE INVENTION

Major advantages reside in the provision of a cleaning concept which effectively avoids toner particle induced scratching of delicate photoconductive surfaces.

In large part, these advantages are achieved through the utilization of a smooth surfaced, compliant cleaning roller, which does not provide a cellular periphery in which toner particles will tend to accumulate and dry, and through the maintenance of a thin layer of dispersant material tending to maintain the concave, smooth surfaced cleaning pad slightly spaced from the scratch and/or wear vulnerable photoconductive surface.

In particular, where a gelatex developer material is employed, the invention affords the advantages of effectively applying a shearing action to the gelatex material, which shearing action tends to induce a transient reduction in the viscosity of the developer, thereby facilitating the overall cleaning action.

Unobviousness of the invention is evidenced by the failure of the art to recognize the manner in which a reverse-rotating, smooth faced, compliant cleaning roller may be employed, without an auxiliary doctor blade engaging the photoconductive surface, to effectively clean liquid developer materials from photoconductive drums without leaving a scratch engendering residue of dried toner material on the cleaning mechanism.

Those familiar with the present disclosure and skilled in the photocopier cleaning art may well recognize, additions, deletions, substitutions, equivalents, and other modifications which would fall within the purview of the invention as set forth in the appended claims.

What is claimed is:

1. A method of cleaning a photoconductive surface comprising:

providing elastically yieldable roller means having a smooth, yieldable periphery adjacent the periphery of a photoconductive surface;

moving said photoconductive surface so as to carry a layer of developer, comprising toner particles dispersed in a gelatex dispersant, generally toward said yieldable roller means;

applying a lubricating liquid to said developer layer;

pressing said yieldable roller means against said developer layer with its axes being parallel to said photoconductive surface and with the smooth yieldable periphery of said elastically, yieldable roller means being arcuately deformed into concave, smooth faced pad means penetrating said developer layer to a depth such that said concave smooth faced pad means is generally spaced from said photoconductive surface by a distance not exceeding the diameter of the minimum sized particles of said toner;

rotating said elastically yieldable roller means so that its periphery moves at a speed at least equal to the speed of said moving photoconductive surface but in a direction opposite thereto, with said rotation being operable to apply a shearing force to said gelatex dispersant operable to reduce the viscosity thereof;

maintaining a gap between said concave, smooth faced, pad means and said photoconductive surface, with said gap having a thickness not exceeding the diameter of said minimum sized toner particles;

scrubbing said photoconductive surface with rotary, yieldable sponge means before said developer layer is engaged by said concave pad means, with said rotating yieldable sponge means being operable to remove toner particles from said developer layer;

causing said rotating, yieldable sponge means to peripherally engage said rotating, elastically yieldable roller means and remove toner particles from said rotating, elastically yieldable roller means; and applying doctor blade means to the periphery of said ɔtating, elastically yieldable roller means to remove ɔner particles therefrom;

said lubricating fluid being applied to said developer layer between said rotating, yieldable sponge means and said rotating, elastically yieldable roller means and being operable to tend to flush at least some of said removed toner particles from said photoconductive surface; and said rotating, yieldable sponge means being compliantly engaged with said doctor blade means and operable to separate toner particles accumulated thereon.

2. A method of cleaning a photoconductive surface ɔmprising:

providing roller means having a smooth periphery adjacent the periphery of a photoconductive surface;

moving said photoconductive surface so as to carry a layer of developer, comprising toner particles dispersed in a liquid dispersant, generally toward said roller means;

applying a lubricating liquid to said developer layer;

pressing said roller means against said developer layer with its axes being parallel to said photoconductive surface;

rotating said roller means so that its periphery moves at a speed at least equal to the speed of said moving photoconductive surface but in a direction opposite thereto;

scrubbing said photoconductive surface with rotary, yieldable sponge means before said developer layer is engaged by said roller means, with said rotating yieldable sponge means being operable to remove toner particles from said developer layer;

causing said rotating, yieldable sponge means to peripherally engage said rotating, roller means and remove toner particles from said rotating, roller means; and applying doctor blade means to the periphery of said rotating, roller means to remove toner particles therefrom;

said lubricating fluid being applied to said developer layer between said rotating, yieldable sponge means and said rotating, roller means and being operable to tend to flush at least some of said removed toner particles from said photoconductive surface; and said rotating, yieldable sponge means being compliantly engaged with said doctor blade means and operable to separate toner particles accumulated thereon.

3. A method of cleaning a photoconductive surface comprising:

providing elastically yieldable roller means having a smooth, yieldable periphery adjacent the periphery of a photoconductive surface;

moving said photoconductive surface so as to carry a layer of developer, comprising toner particles dispersed in a gelatex dispersant, generally toward said yieldable roller means;

applying a lubricating liquid to said developer layer;

pressing said yieldable roller means against said developer layer with its axes being parallel to said photoconductive surface and with the smooth yieldable periphery of said elastically, yieldable roller means being arcuately deformed into concave, smooth faced pad means penetrating said developer layer to a depth such that said concave smooth faced pad means is generally spaced from said photoconductive surface by a distance not exceeding the diameter of the minimum sized particles of said toner;

rotating said elastically yieldable roller means so that its periphery moves at a speed at least equal to the speed of said moving photoconductive surface but in a direction opposite thereto, with said rotation being operable to apply a shearing force to said gelatex dispersant operable to reduce the viscosity thereof;

maintaining a gap between said concave, smooth faced, pad means and said photoconductive surface, with said gap having a thickness not exceeding the diameter of said minimum sized toner particles; and applying doctor blade means to the periphery of said rotating, elastically yieldable roller means to remove toner particles therefrom.

4. A method of cleaning a photoconductive surface comprising:

providing elastically yieldable roller means having a smooth, yieldable periphery adjacent the periphery of a photoconductive surface;

moving said photoconductive surface so as to carry a layer of developer, comprising toner particles dispersed in a liquid dispersant, generally toward said yieldable roller means;

applying a lubricating liquid to said developer layer;

pressing said yieldable roller means against said developer layer with its axes being parallel to said photoconductive surface and with the smooth yieldable periphery of said elastically, yieldable roller means being arcuately deformed into concave, smooth faced pad means penetrating said developer layer to a depth such that said concave smooth faced pad means is generally spaced from said photoconductive surface by a distance not exceeding the diameter of the minimum sized particles of said toner;

rotating said elastically yieldable roller means so that its periphery moves at a speed at least equal to the speed of said moving photoconductive surface but in a direction opposite thereto;

maintaining a gap between said concave, smooth faced, pad means and said photoconductive surface, with said gap having a thickness not exceeding the diameter of said minimum sized toner particles;

applying doctor blade means to the periphery of said rotating, elastically yieldable roller means to remove toner particles therefrom.

5. Apparatus for cleaning a photoconductive surface comprising:

elastically yieldable roller means having a smooth, yieldable periphery located adjacent the periphery of a photoconductive surface;

means for moving said photoconductive surface so as to carry a layer of developer, comprising toner particles dispersed in a gelatex dispersant, generally toward said yieldable roller means;

means for applying a lubricating liquid to said developer layer;

means for pressing said yieldable roller means against said developer layer with its axes being parallel to said photoconductive surface and with the smooth yieldable periphery of said elastically, yieldable roller means being arcuately deformed into concave, smooth faced pad means penetrating said developer layer to a depth such that said concave smooth faced pad means is generally spaced from said photoconductive surface by a distance not exceeding the diameter of the minimum sized particles of said toner;

means for rotating said elastically yieldable roller means so that its periphery moves at a speed at least equal to the speed of said moving photoconductive surface but in a direction opposite thereto, with said rotation being operable to apply a shearing force to said gelatex dispersant operable to reduce the viscosity thereof;

means for maintaining a gap between said concave, smooth faced, pad means and said photoconductive surface, with said gap having a thickness not exceeding the diameter of said minimum sized toner particles;

means for scrubbing said photoconductive surface with rotary, yieldable sponge means before said developer layer is engaged by said concave pad means, with said rotating yieldable sponge means being operable to remove toner particles from said developer layer;

means for causing said rotating, yieldable sponge means to peripherally engage said rotating, elastically yieldable roller means and remove toner particles from said rotating, elastically yieldable roller means; and doctor blade means applied to the periphery of said rotating, elastically yieldable roller means to remove toner particles therefrom;

said lubricating fluid being applied to said developer layer between said rotating, yieldable sponge means and said rotating, elastically yieldable roller means and being operable to tend to flush at least some of said removed toner particles from said photoconductive surface; and said rotating, yieldable sponge means being compliantly engaged with said doctor blade means and operable to separate toner particles accumulated thereon.

6. Apparatus for cleaning a photoconductive surface comprising:

roller means having a smooth, periphery located adjacent the periphery of a photoconductive surface;

means for moving said photoconductive surface so as to carry a layer of developer, comprising toner particles dispersed in a liquid dispersant, generally toward said roller means;

means for applying a lubricating liquid to said developer layer;

means for pressing said roller means against said developer layer with its axes being parallel to said photoconductive surface;

means for rotating said roller means so that its periphery moves at a speed at least equal to the speed of said moving photoconductive surface but in a direction opposite thereto;

means for scrubbing said photoconductive surface with rotary, yieldable sponge means before said developer layer is engaged by said roller means, with said rotating yieldable sponge means being operable to remove toner particles from said developer layer;

means for causing said rotating, yieldable sponge means to peripherally engage said rotating, roller means and remove toner particles from said rotating, roller means; and doctor blade means applied to the periphery of said rotating roller means to remove toner particles therefrom;

said lubricating fluid being applied to said developer layer between said rotating, yieldable sponge means and said rotating, roller means and being operable to tend to flush at least some of said removed toner particles from said photoconductive surface; and said rotating, yieldable sponge means being compliantly engaged with said doctor blade means and operable to separate toner particles accumulated thereon.

7. Apparatus for cleaning a photoconductive surface comprising:

elastically yieldable roller means having a smooth, yieldable periphery located adjacent the periphery of a photoconductive surface;

means for moving said photoconductive surface so as to carry a layer of developer, comprising toner particles dispersed in a gelatex dispersant, generally toward said yieldable roller means;

means for applying a lubricating liquid to said developer layer;

means for pressing said yieldable roller means against said developer layer with its axes being parallel to said photoconductive surface and with the smooth yieldable periphery of said elastically, yieldable roller means being arcuately deformed into concave, smooth faced pad means penetrating said developer layer to a depth such that said concave smooth faced pad means is generally spaced from said photoconductive surface by a distance not exceeding the diameter of the minimum sized particles of said toner;

means for rotating said elastically yieldable roller means so that its periphery moves at a speed at least equal to the speed of said moving photoconductive surface but in a direction opposite thereto, with said rotation being operable to apply a shearing force to said gelatex dispersant operable to reduce the viscosity thereof;

means for maintaining a gap between said concave, smooth faced, pad means and said photoconductive surface, with said gap having a thickness not exceeding the diameter of said minimum sized toner particles; and doctor blade means applied to the periphery of said rotating, elastically yieldable roller means to remove toner particles therefrom.

8. Apparatus for cleaning a photoconductive surface comprising:

elastically yieldable roller means having a smooth, yieldable periphery adjacent the periphery of a photoconductive surface;

means for moving said photoconductive surface so as to carry a layer of developer, comprising toner particles dispersed in a liquid dispersant, generally toward said yieldable roller means;

means for applying a lubricating liquid to said developer layer;

means for pressing said yieldable roller means against said developer layer with its axes being parallel to said photoconductive surface and with the smooth yieldable periphery of said elastically, yieldable roller means being arcuately deformed into concave, smooth faced pad means penetrating said developer layer to a depth such that said concave smooth faced pad means is generally spaced from said photoconductive surface by a distance not exceeding the diameter of the minimum sized particles of said toner;

means for rotating said elastically yieldable roller means so that its periphery moves at a speed at least equal to the speed of said moving photoconductive surface but in a direction opposite thereto;

means for maintaining a gap between said concave, smooth faced, pad means and said photoconductive surface, with said gap having a thickness not exceeding the diameter of said minimum sized toner particles; and doctor blade means applied to the periphery of said rotating, elastically yieldable roller means to remove toner particles therefrom.

* * * * *